US005777285A

United States Patent [19]

Frank et al.

[11] Patent Number: 5,777,285

[45] Date of Patent: Jul. 7, 1998

[54] AUTOMOTIVE INERTIA SWITCH

[75] Inventors: Carl Frank, Sharon; James A. Mallett, East Milton, both of Mass.

[73] Assignee: Joseph Pollak Corporation, Boston, Mass.

[21] Appl. No.: 823,787

[22] Filed: Mar. 24, 1997

[51] Int. Cl.[6] ..... H01H 35/02

[52] U.S. Cl. ..... 200/61.5; 200/61.45 R; 200/61.52

[58] Field of Search ..... 200/61.45 R, 61.5, 200/61.52, 61.53; 640/467, 666

[56] References Cited

U.S. PATENT DOCUMENTS

| | | | |
|---|---|---|---|
| 4,000,408 | 12/1976 | McCartney | 307/10 |
| 4,191,868 | 3/1980 | Sunde | 200/61.5 |
| 4,308,438 | 12/1981 | Rossel et al. | 200/61.5 |
| 4,326,111 | 4/1982 | Jackman | 200/61.45 R |
| 4,371,763 | 2/1983 | Jackman et al. | 200/61.45 R |
| 4,533,801 | 8/1985 | Jackman et al. | 200/61.45 R |
| 5,038,006 | 8/1991 | Lowe, Sr. et al. | 200/61.5 |
| 5,149,926 | 9/1992 | Ohno | 200/61.45 R |
| 5,178,323 | 1/1993 | Hanson | 237/2 A |
| 5,391,845 | 2/1995 | Haas et al. | 200/61.45 R |

*Primary Examiner*—Renee S. Luebke
*Assistant Examiner*—Michael J. Hayes
*Attorney, Agent, or Firm*—Kenway & Crowley

[57] ABSTRACT

An automotive inertia switch including a switch body which houses a movable plunger weight; a button guide structure with a cylindrical nest, a switch reset button, a wiper contact, and a compression spring. Switching action is caused by the vertical movement of the weight. In an untripped state, a tip of the weight is spring biased by the compression spring into the nest. In response to a rapid change in the acceleration of the vehicle, e.g. a crash, the tip is dislodged from the nest and the weight is forced by the spring to move upwardly against the button. Vertical movement of the weight causes the wiper contact, which is in pressing engagement with the opposite end of the weight, to move between switching positions to make and break electrical connection of a common terminal to the fuel pump or a switch status indicator. The tripped status of the switch may be indicated by the switch status indicator, or by visual observation of the outward projection of the button. The switch may be reset by simply pushing the button downward to force the tip back into the nest.

18 Claims, 4 Drawing Sheets

AUTOMOTIVE INERTIA SWITCH

FIELD OF THE INVENTION

The present invention relates in general to automotive switches, and in particular to an automotive inertia switch which automatically removes the electrical input to a fuel pump upon the occurrence of a rapid change in the acceleration or deceleration of the vehicle.

BACKGROUND OF THE INVENTION

The fuel system for almost any vehicle incorporates a fuel pump which pumps fuel from a fuel tank to the combustion chamber of the vehicle through a fuel regulating device such as a carburetor or fuel injectors. The fuel pump includes an electric motor which is driven by electricity supplied by the vehicle battery. Typically, when the vehicle is running, the fuel pump operates continuously to supply fuel for operating the engine. The fuel pump is disabled only when the ignition is turned off by the operator to break the electrical connection between the battery and the fuel pump.

Although this arrangement has proven to be reliable in terms of providing fuel to the engine from the fuel tank, when the vehicle is involved in an accident or crash a dangerous situation can result. When a crash occurs, the normally closed system of fuel delivery from the fuel tank to the engine can be damaged, e.g. a fuel line may be dislodged, the fuel pump may be damaged, etc.. At the same time, the ignition may remain on, causing the fuel pump to continue pumping fuel from the fuel tank and out of the damaged area of the system. If the fuel spills into an area where a fire or spark has been caused by the accident, a serious danger of combustion or explosion can result. Even where the fuel is not ignited, the fuel must be cleaned from the road or ground upon which it spills to prevent environmental damage. Despite these concerns, however, no reliable and cost efficient system has been developed for disabling a vehicle fuel pump upon the occurrence of a crash to prevent the dangers of a fuel spill.

Accordingly, there is a need in the art for an automotive switch, particularly an automotive inertia switch, which automatically disables the fuel pump upon the occurrence of a crash, and which may be easily reset from a tripped to an untripped position by an operator.

OBJECTS OF THE INVENTION

Thus, a primary object of the present invention is to provide an inertia switch which automatically removes electrical input to a vehicle fuel pump upon the occurrence of a rapid change in the acceleration of the vehicle, e.g. a crash.

Another object of the present invention is to provide a inertia switch which is easily reset from a tripped state to an untripped state.

A further object of the invention is to provide an inertia switch which provides a readily observable indication of the switch state.

A still further object of the present invention is to provide an inertia switch which improves the safety of vehicles as delivered to a customer.

Yet another object of the present invention is to provide an inertia switch which is of a simple and cost efficient design.

Still another object of the present invention is to provide an inertia switch which is compact and is easily installed in a vehicle.

Yet another object is the provision of a switch which cannot be unintentionally reset during secondary impacts.

These and other objects of the present invention will become apparent from a review of the description provided below.

SUMMARY OF THE INVENTION

The inertia switch of the present invention is organized about the concepts of: (1) automatically and reliably removing electrical power to a vehicle fuel pump upon the occurrence of a crash; and (2) providing a simple means for resetting the switch to an untripped condition after it has been tripped. The switch includes a switch body which houses a movable plunger weight; a button guide structure with a cylindrical nest, a switch reset button, a wiper contact, and a compression spring. The button guide structure is configured as a spoked wheel with the cylindrical nest as the hub of the wheel. The button includes a center tube portion which slides over the nest, and axial projections which mate with the interstices between the spokes on the button guide structure. Thus, the button mates with the button guide structure to provide means for resetting the switch from a tripped to an untripped condition with the switch mounted with its axis vertical, button up.

In an untripped condition, gravity forces the button downward so that angled surfaces on its axial projections are substantially in line with a conical inner surface of the nest. The compression spring pushes against the wiper contact which in turn pushes against a bottom of the weight to force the weight upward. A radiused tip on the top portion of the weight is, thereby, forced along the conical inner surface of the nest into the center of the nest. In this state, the wiper contact electrically connects the switch N.C. terminal to the common terminal.

Upon a rapid change in the acceleration of the vehicle, a force is exerted on the weight which causes the tip of the weight to ride out of the nest, where it impacts against an angled surface of the button. Since the weight is biased upward by the spring, when the tip leaves the nest the weight forces the button upward against the top portion of the switch body. As the weight is forced upward, the pivot pin moves axially upward, causing the wiper contact to break the connection between the common and N.C. terminals and make the connection between the common terminal and an N.O. terminal. Advantageously, if the N.O. terminal is connected to a switch state indicator, a signal can be provided to the operator which indicates that the switch has changed state. Also, the movement of the button outward from the top of the switch body provides a visual signal that the switch has changed state.

The switch is reset to the untripped state by physically pushing down on the button. The angles of the angled surfaces of the button and inner conical surface of the nest are chosen such that the component of the spring force acting along the angled surface and the nest surface is large enough to cause the tip to rise to the center of the nest. The axial movement of the weight caused by resetting of the button causes the wiper to break the N.O. to common connection and make the N.C. to common connection. The lowering of the button and the breaking of the N.O. to common circuit are both signals that the switch has changed to an untripped state. Additionally, the movement of the weight into the nest, occurring when the button is pushed down to reset the switch, gives the operator tactile feedback that the switch has reset.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

Figure 1:
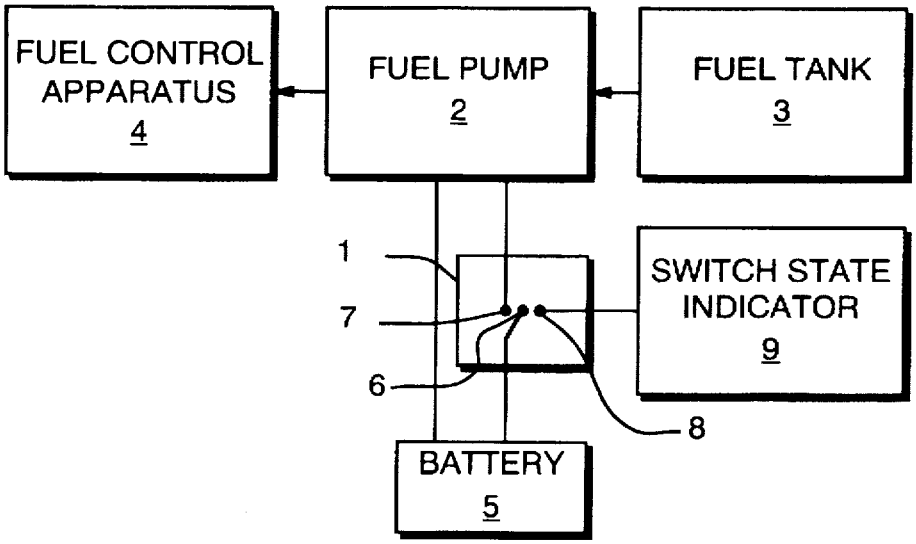
FIG. 1: is a block diagram of an automotive fuel pump circuit incorporating a switch according to the present invention.

Referring to FIG. 1 of the drawing, there is shown the arrangement of a preferred switch 1 according to the present invention relative to an automotive fuel pump 2. As is known, the fuel pump is provided for pumping fuel from the fuel tank 3 to a fuel control apparatus 4, e.g. a carburetor or fuel injectors. The electrical input for operating the fuel pump 2 is supplied by the automotive battery 5.

In the preferred arrangement, the negative terminal of the battery is electrically connected to the negative terminal of the fuel pump, while the positive terminal is connected to a common terminal 6 of the inertia switch 1. In an untripped state, the common terminal 6 is connected to the N.C. terminal 7 of the inertia switch which, in turn, is connected to the positive terminal of the fuel pump 2. Thus, in the untripped state, the positive terminal of the battery 5 is connected to the positive terminal of the fuel pump 2 through the inertia switch 1.

The N.O. terminal 8 of the inertia switch 1 may be connected to a switch state indicator 9 which may be in the form of an LED display. The switch state indicator provides an operator with an indication of the state of the switch. As will be described in detail below, upon the occurrence of a crash, the inertia switch breaks the electrical connection between the battery 5 and the fuel pump 2 (i.e. between the common 7 and N.C. 6 terminals), and optionally makes a connection between the battery and the switch state indicator (i.e. between the common terminal 7 and the N.O. terminal 8). Thus, the electrical input to the fuel pump is disabled to halt the flow of fuel from the fuel tank to the fuel control apparatus. In this condition, the switch state indicator provides a signal indicating that the switch is in a tripped state wherein the fuel pump is disabled.

Figure 5:
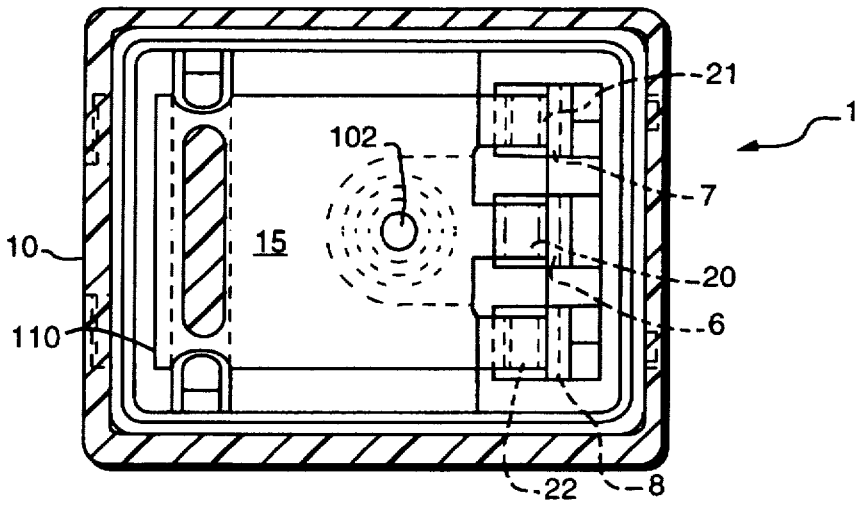
FIG. 5: is a sectional view of the switch shown in FIG. 2 taken along lines V—V showing the wiper contact.

The details of the switch 1 according to the present invention will now be described in connection with the sectional view thereof provided in FIG. 2. As shown, the switch body 10 houses a movable plunger weight 11; a button guide structure 12 with a cylindrical nest 13, a switch reset button 14, a wiper contact 15, and a compression spring 16. The common 6, N.C. 7 and N.O. 8 terminals, as shown also in FIGS. 3 and 5, extend through the wall 17 of a base section 18, and are secured to a sidewall 19 of the base section 18 adjacent three corresponding contact ends 20, 21, 22, respectively, of the wiper contact 15. As will be described in detail below, in dependence of the position the weight 11, the wiper contact 15 makes and breaks electrical connections between the common and N.C. or N.O. terminals.

Figure 3:
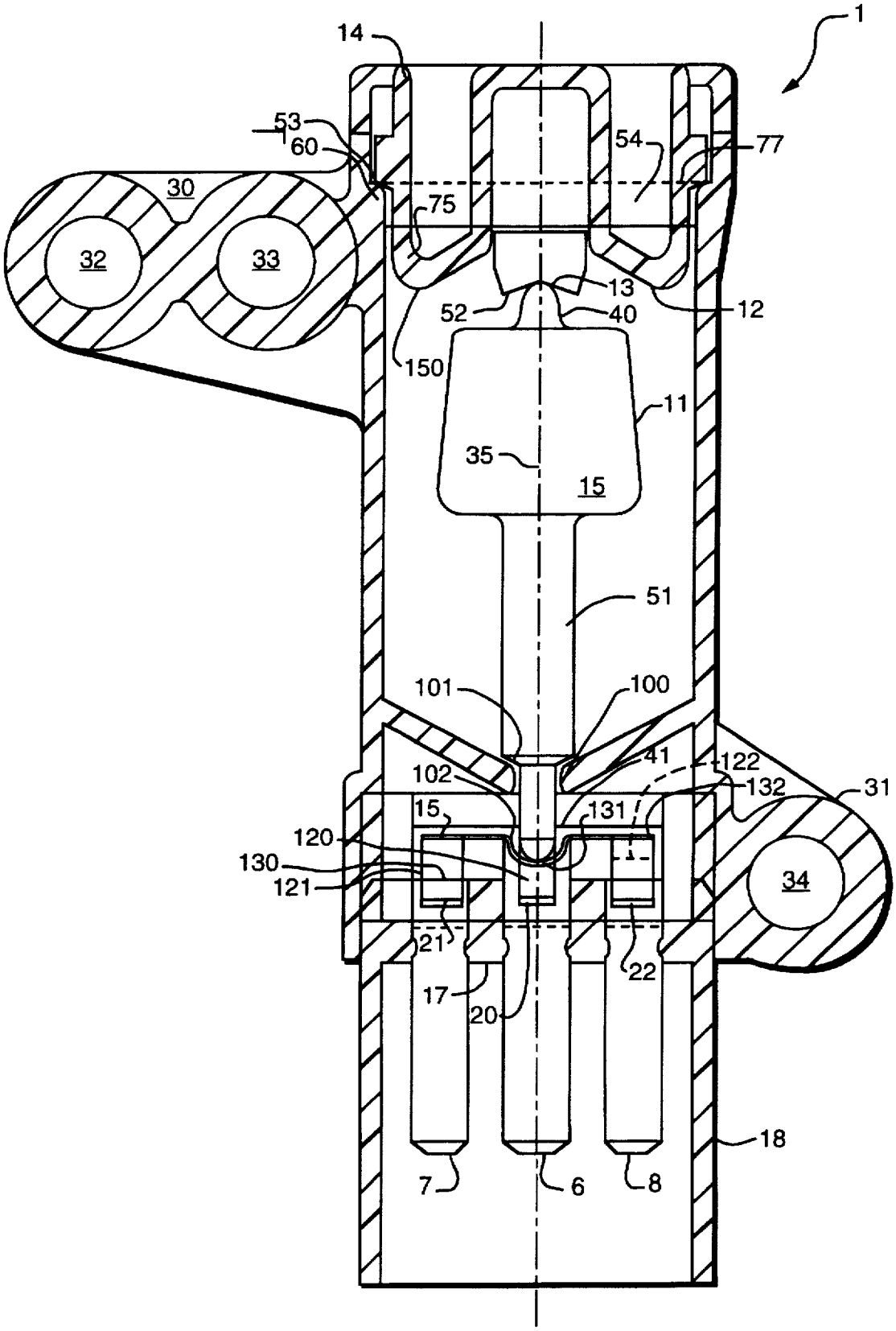
FIG. 3: is a sectional view of the switch shown in FIG. 2 taken along lines III—III.
Figure 4:
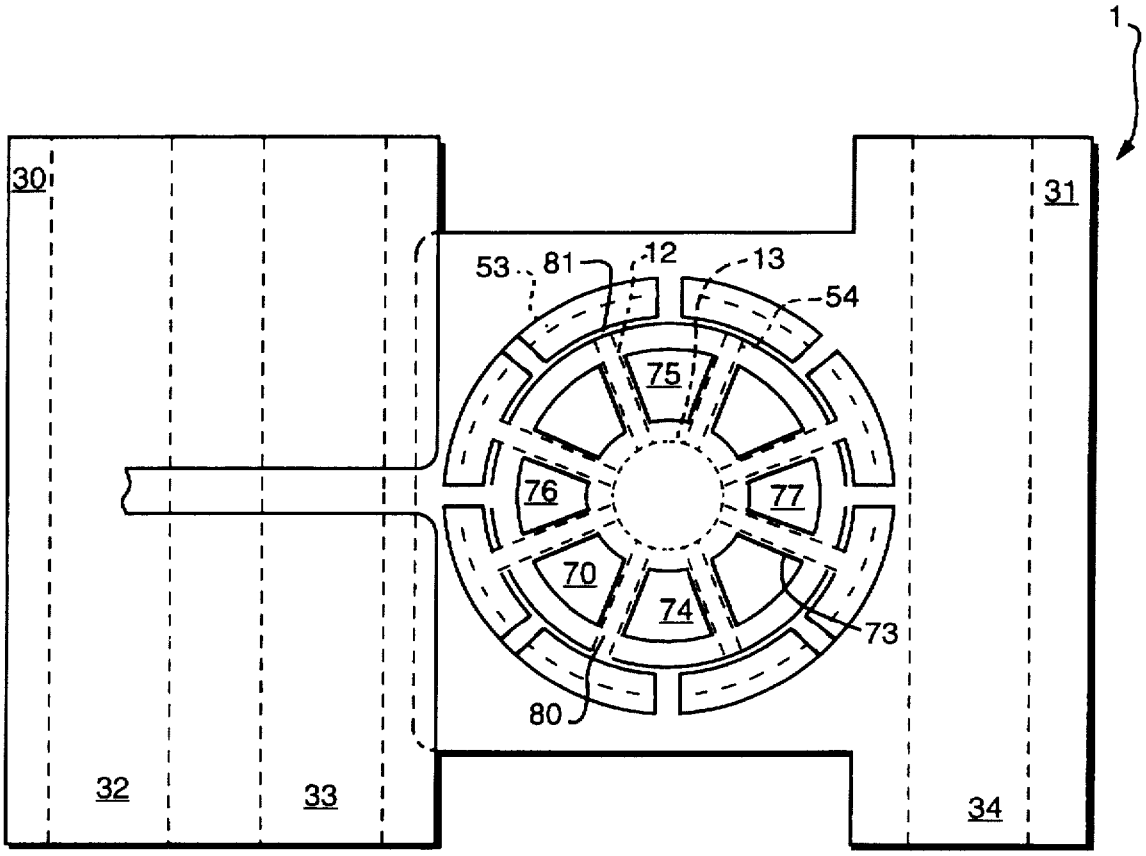
FIG. 4: is a top view of the switch shown in FIG. 2.

As best shown in FIGS. 3 and 4, the body 10 preferably has appropriate mounting projections 30, 31 for mounting the switch in an upright position in the automobile through screw holes 32, 33, 34. By "upright position" it is meant that the axis 35 of the weight 11 in an untripped condition is substantially normal to ground or road upon which the vehicle rests with the radiused tip 40 of the weight at a distance further from the road than the pivot pin 41. It is to be understood, however, that it would also be possible to mount the switch in a non-upright position with the sacrifice of performance, or by including appropriate springs to maintain the interrelationship of the parts. In terms of the physical construction of the switch, it is preferred that the body 10, the base 18, and the button 14 be molded from plastic, while the plunger weight 11 is die cast from metal. The terminals 6, 7 and 8 are insert molded into the plastic base. The nest 13 is fabricated from metal.

Figure 2:
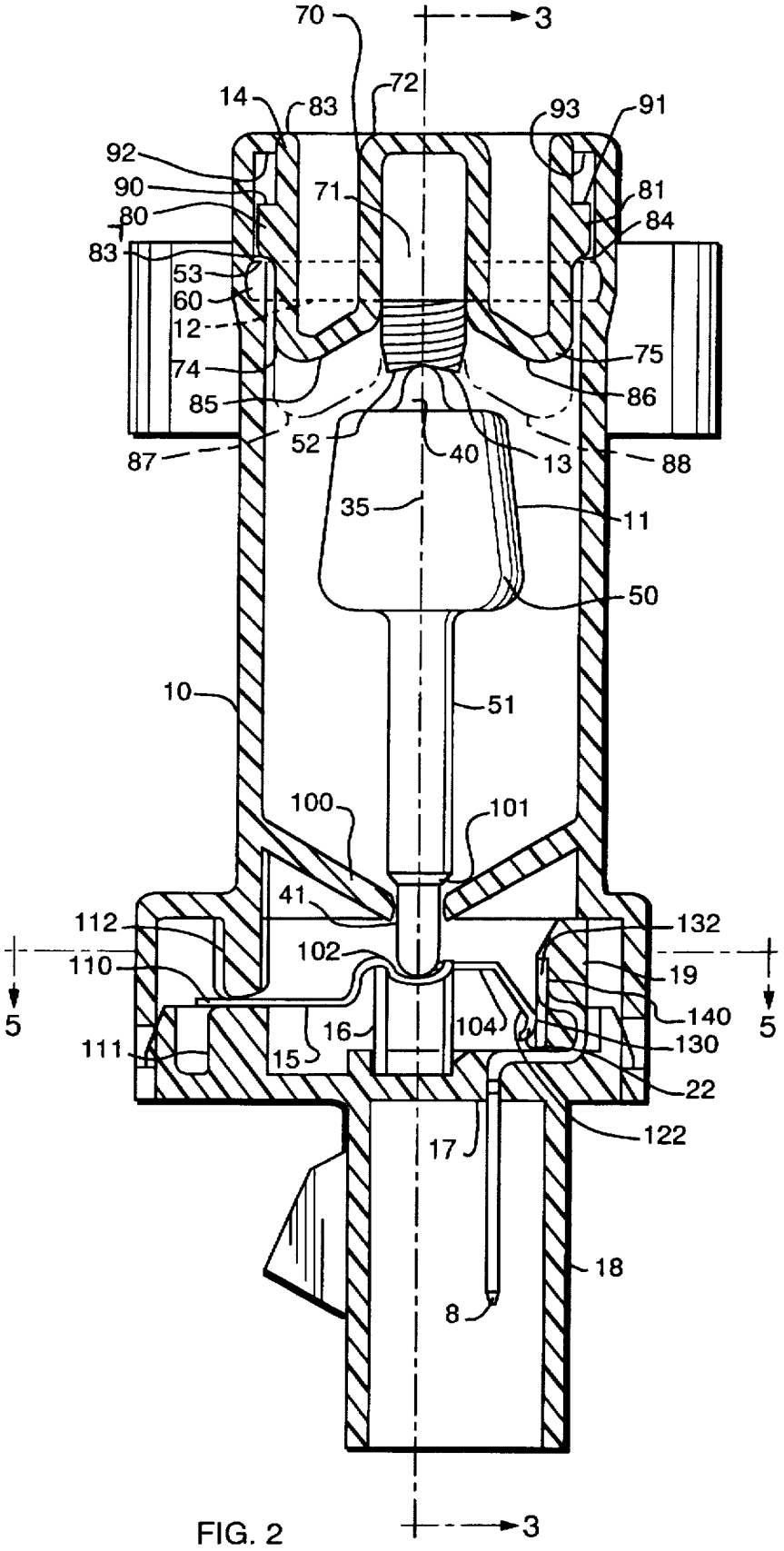
FIG. 2: is a side sectional view of a preferred switch according to the present invention.

Referring particularly to FIG. 2, the plunger weight includes the radiused tip 40, a head 50, a shaft 51, and the cylindrical pivot pin 41. When the switch 1 is in an untripped position, the tip 40 of the weight rests against a conical inner surface 52 of the cylindrical nest 13. As shown in FIG. 4, the cylindrical nest 13 forms the hub of a the button guide structure 12, and is connected to the rim 53 of the button guide structure by spokes, e.g. spoke 54. The button guide structure 12 is secured within the body with its rim 53 resting on a shelf 60.

A button 14 mates with the button guide structure 12, and has a spoked configuration with a center cylindrical tube 70 having an open end 71 and a closed end 72. The open end 71 of the center cylindrical tube slides over the nest 13 allowing axial motion of the button 14 relative to the nest. Spokes, e.g. spoke 73, on the button 14 separate angled axial projections, e.g. projections 74, 75, 76, 77, which extend beyond the button spokes 73 and mate the interstices between the spokes 54 on the button guide structure. Thus, as the center cylindrical tube 70 slides downward over the nest 13, the axial projections, e.g. 74, 75 in FIG. 2, extend through the interstices between the spokes 54 of the button guide structure.

Travel of the button 14 relative to the nest 13 is limited by stops, e.g. 80, 81 in FIG. 2, formed on the outer surface of the button 14. Downward travel is limited by engagement of the chamfered bottom edge 83, 84 of the stops with the rim 53 of the button guide structure. At the maximum downward travel position of the button, as shown by the dashed lines 87, 88, the angled surfaces 85, 86 of the projections 74, 75, are substantially in line with the conical inner surface 52 of the nest. Upward travel is limited by engagement of the upper surface 90, 91 of the stops 80, 81 with the bottom 92, 93 of a reduced diameter portion of the body. The button 14 might alternatively be held in its uppermost position by a spring or other means, only moving to its lower position during resetting of the switch.

At the opposite end of the weight 11, the pivot pin 41 extends through a circular pivot hole 100 in the switch body, and is axially and pivotably movable therein. Axial travel of the pivot pin into the pivot hole 100 is limited by the chamfered edge 101 on the shaft 51. A dimple 102 in the wiper contact 15 is biased into pressing engagement with the end of pivot pin by the compression spring 16 which is fixed between the wall 17 of the base section 18 and a bottom side 104 of the wiper contact 15.

The end 110 of wiper contact is secured within the body between a projection 111 on the base section 18 and an opposed projection 112 on the body 10. The projections 111 and 112 restrict vertical movement, but do not pinch the wiper, thus allowing it to pivot. As shown particularly in FIGS. 2 and 3, the contact ends. 20, 21, 22 of the wiper contact are formed on an angled legs 120, 121, 122 of the contact which extend toward the base section 18 relative to the dimple 102.

This wiper and contact configuration, as shown in FIG. 2, allows the motion created by the movement of the weight to be multiplied by approximately two at the contact interface. This extra motion is advantageous, as it reduces the tolerance of the components required to guarantee the proper timing of the switching function and the moving of the weight out of the nest.

The ends 130, 131, and 132 of the N.C. 7, common 6, and N.O. 8 terminals, respectively, are arranged relative to the contact ends 21, 20, and 22 to achieve the desired switching action. The common terminal 6 enters the body through the wall 17 of the base section and extends across the full length of the contact notch 140 in the wall 19 of the base section. Thus, the contact end 20 is always in electrical contact with the common terminal 6. The N.C. terminal 7, however, ends about half-way across the contact notch 140. The N.O. terminal 8 dips underneath the contact notch 140 in the portion of the notch which linearly corresponds to the location of the N.O. terminal 8. The N.C. terminal then bends upward and is secured in the second-half of the contact notch 140 which is linearly beyond the end 121 of the N.O. terminal.

With this arrangement, when the switch is in an untripped condition the wiper contact is at position A in FIG. 2. At this point, the contact 20 is in electrical contact with the common terminal 6, the contact 21 is in electrical contact with the N.C. terminal 7, and the contact 22 is separated from the N.O. terminal 8. Thus, in an untripped state electrical contact between the common and N.C. terminals is achieved through the wiper contact.

When the switch is in a tripped state, the pivot pin 41 moves axially upward in the pivot hole 100, and the compression spring 16 forces the wiper contact to move to the tripped position at B in FIG. 2. In the tripped state, the contact 20 is in electrical contact with the common terminal 6, the contact 21 is removed from electrical contact with the N.C. terminal 1, and the contact 22 is in contact with the N.O. terminal 8. Thus, electrical contact is established between the common and N.O. terminals in a tripped state of the switch.

The operation of a preferred switch according to the present invention will now be described with reference to FIGS. 2 and 3. Since the switch is mounted in an upright or vertical position, gravity pulls the button 14 to rest on the rim 53 of the button guide structure 12. In this untripped state, the radiused tip 40 rests in the center of the nest 13. The compression spring 16 pushes against the wiper 15 which, in turn, pushes the weight 11 upward forcing the tip into the nest. The sloped conical surface 52 of the nest guides the tip to the center of the nest. In this state, the wiper contact 15 is in the untripped position A shown in FIG. 2, and electrically connects the N.C. terminal 7 to the common terminal 6.

A rapid change in the acceleration of the vehicle, and thus the switch, causes a force to be exerted on the weight 11. The force on the weight causes the tip 41 to ride down the conical surface 52 of the nest and then out of the nest where it impacts against the angled surface 150 of one of the projections 53, as shown in dashed lines in FIG. 3. Since the weight is biased upward by the spring 16, when the tip leaves the nest the weight forces the button 14 upward causing the stops 80, 81, to impact against the bottoms 90, 91 of the reduced diameter portions of the base section. The pivot pin 41 moves axially upward in the pivot hole 100, causing the wiper to move to the upper position B to break the contact between the common 6 and N.C. 7 terminals and make the connection between the common 6 and N.O. terminal 8. Advantageously, if the N.O. terminal 8 is connected to a switch state indicator 9, as shown in FIG. 1, a signal can be provided to the operator which indicates that the switch has changed state. Also, the movement of the button outward to the top of the switch body provides a visual signal that the switch has changed state.

The button in its most upward position is within the switch body to reduce the possibility of the switch not tripping when it should, for example, because an object of sufficient mass has fallen on the button, preventing its upward movement.

The switch is reset to the untripped state by physically pushing down on the button 14. As discussed above, the angled surfaces on the axial projections are designed such that they are substantially in line with the nest when the button is forced to the lower stop. The angles of the angled surfaces of the button and inner conical surface of the nest are chosen such that the component of the spring force acting along an angled surface and the nest surface is large enough to cause the tip to rise to the center of the nest. The axial movement of the weight caused by resetting of the button causes the wiper to break the N.O. to common connection and make the N.C. to common connection. The lowering of the button and the breaking of the N.O. to common circuit are both signals that the switch has changed to an untripped state. Additionally, the movement of the weight occurring when the button is pushed down to reset the switch gives the operator tactile feedback that the switch has reset.

Thus, according to the present invention there is provided an inertia switch which reliably and efficiently removes the electrical connection to an automobile fuel pump upon the occurrence of a crash. The switching action is caused by the vertical movement of a weight having a tip which is spring biased into a nest. In response to a rapid change in the acceleration of the vehicle, e.g. a crash, the tip is dislodged from the nest and the weight is forced by the spring to move upwardly against a button. Vertical movement of the weight causes a wiper contact connected to an opposite end thereof to move between switching positions to make and break electrical connection of a common terminal to the fuel pump or a switch status indicator. The tripped status of the switch may be indicated by a switch status indicator or by visual observation of the outward projection of the button. The switch may be reset by simply pushing the button downward to force the tip back into the nest.

The embodiments which have been described herein, however, are but some of the several which utilize this invention and are set forth here by way of illustration but not of limitation. For example, the button could be split into two parts to allow the introduction of a continuous angled surface on the bottom of the button to help the tip ride into the nest. The button could also be designed such that the angled surface travels below flush with the inner conical surface of the nest upon reset. In this embodiment, a spring or other mechanism would be necessary to pull the button back upward above flush with the nest to prevent the button from being hung up when the switch is tripped.

If it is desired to provide for manual tripping of the switch, a small radial opening may be formed in the housing adjacent the weight 11, and a rod or screw driver may be inserted to push the weight out of the nest.

In addition, it will be apparent to those skilled in the art that the lower end of the weight may be modified such that the spring acts directly on the weight rather than on the wiper contact. In this configuration, the pivot pin would be modified to pull the weight up when the switch is tripped. It is obvious that many other embodiments, which will be readily apparent to those skilled in the art, may be made without departing materially from the spirit and scope of this invention.

What is claimed is:

1. An automotive inertia switch for controlling electrical input to a fuel pump comprising:

a switch body;

a weight disposed in said body, said weight having a first end and a second end;

a nest disposed in said body adjacent said first end of said weight;

a spring acting on said weight, said spring biasing said weight toward said nest; and a wiper contact adjacent said second end of said weight, said wiper contact being movable with respect to at least two contact terminals in dependence of movement of said weight, wherein, in an untripped state of said switch, a tip of said weight is biased by said spring into said nest, and said wiper contact makes an electrical connection between a pair of said at least two contact terminals; and wherein, upon a rapid change in the acceleration of said switch, said switch moves to a tripped state wherein said tip is dislodged from said nest and said electrical connection between said pair of said at least two contact terminals is broken.

2. An automotive inertia switch according to claim 1, said switch further comprising:

a button adjacent said nest and axially movable with respect to said nest, wherein in said tripped state of said switch said tip of said weight contacts said button, and wherein said switch is reset to an untripped state by pushing said button downward to force said tip into said nest.

3. An automotive inertia switch according to claim 2, wherein said nest includes an angled inner surface, and wherein said button includes an angled lower surface, said angle of said lower surface of said button being substantially in line with said angled inner surface of said nest when said button is in a maximum downward travel position.

4. An automotive inertia switch according to claim 2, wherein said button is disposed within said body such that the top of said button is flush with the top of said body when said switch is in said tripped state.

5. An automotive inertia switch according to claim 2, wherein said nest forms a portion of a button guide structure, said button guide structure being configured as a spoked wheel with said nest forming a hub of said wheel being connected to a rim of said button guide structure by spokes, and wherein said button includes a center portion which slides axially over said nest and axial projections which mate with interstices between said spokes of said button guide structure, said projections having surfaces which extend beyond a bottom portion of said nest when said button is in a maximum downward travel position, and wherein, in a tripped state of said switch, said tip impacts against at least one of said projections, forcing said button upward.

6. An automotive inertia switch according to claim 5, wherein said nest includes an angled inner surface, and wherein said axial projections are angled, said angles of said axial projections being substantially in line with said angled inner surface of said nest when said button is in said maximum downward travel position.

7. An automotive inertia switch according to claim 1, wherein said second end of said weight comprises a pivot pin, said pivot pin being movably disposed within a pivot hole formed in said body, and wherein said wiper contact is biased by said spring into pressing engagement with an end of said pivot pin.

8. An automotive inertia switch according to claim 1, said switch further comprising a base portion, said base portion being removably mountable to a bottom of said body adjacent said second end of said weight; wherein said spring is disposed between a wall of said base portion and a bottom of said wiper contact.

9. An automotive inertia switch according to claim 8, wherein said wiper contact is secured between a vertical projection on said body and a vertical projection on said base portion.

10. An automotive inertia switch according to claim 7, wherein a dimple is formed in said wiper contact, and said end of said pivot pin is in pressing engagement with said dimple.

11. An automotive inertia switch according to claim 1, wherein said switch includes three of said contact terminals, and wherein, in said untripped state of said switch, said wiper contact makes said electrical connection with a first one and a second one of said contact terminals, and in a tripped state of said switch said wiper contact makes an electrical connection with said first one of said terminals and a third one of said terminals.

12. An automotive inertia switch for controlling electrical input to a fuel pump comprising:

a switch body;

a weight disposed in said body, said weight having a first end and a second end, said second end of said weight comprising a pivot pin movably disposed within a pivot hole formed in said body;

a button guide structure disposed in said body adjacent said first end of said weight, said button guide structure being configured as a spoked wheel with a nest forming a hub of said wheel, said nest being connected to a rim of said button guide structure by spokes;

a button adjacent said nest and axially movable with respect to said nest, said button including a center portion which slides axially over said nest and vertical projections which mate with interstices between said spokes of said button guide structure;

a wiper contact adjacent said second end of said weight, said wiper contact being movable with respect to at least two contact terminals in dependence of movement of said weight; and a spring disposed in said body, said spring biasing said wiper contact into pressing engagement with an end of said pivot pin thereby biasing said weight toward said nest, wherein, in an untripped state of said switch, a tip of said weight is biased by said spring into said nest, and said wiper contact makes an electrical connection between a pair of said at least two contact terminals; and wherein, upon a rapid change in the acceleration of said switch, said switch moves to an tripped state wherein said tip is dislodged from said nest into contact with said button and said electrical connection between said pair of said at least two contact terminals is broken; and wherein said switch is reset to an untripped state by pushing said button downward to force said tip into said nest.

13. An automotive inertia switch according to claim 12, wherein said nest includes an angled inner surface, and wherein said vertical projections of said button are angled, said angles of said vertical projections being substantially in line with said angled inner surface of said nest when said button is in a maximum downward travel position.

14. An automotive inertia switch according to claim 12, said switch further comprising a base portion, said base portion being removably mountable to a bottom of said body adjacent said second end of said weight; wherein said spring is disposed between a wall of said base portion and a bottom of said wiper contact.

15. An automotive inertia switch according to claim 14, wherein said wiper contact is secured between a vertical projection on said body and a vertical projection on said base portion.

16. An automotive inertia switch according to claim 12, wherein a dimple is formed in said wiper contact, and said end of said pivot pin is in pressing engagement with said dimple.

17. An automotive inertia switch according to claim 12, wherein said switch includes three of said contact terminals, and wherein, in said untripped state of said switch, said wiper contact makes said electrical connection with a first one and a second one of said contact terminals, and in a tripped state of said switch said wiper contact makes an electrical connection with said first one of said terminals and a third one of said terminals.

18. An inertia switch for changing the conduction of current in an electrical circuit for a fuel pump in response to decelerating forces comprising a base, switching members mounted on said base including a common terminal, a normally open terminal, a normally closed terminal, and a wiper normally connecting the normally closed terminal to the common terminal, a switch body including a housing fitted to said base and enclosing said switching members, a vertically movable weight disposed in said housing and having upper and lower ends, said lower end being disposed against the upper surface of said wiper, a spring set upon said base and normally urging said wiper upwardly against said lower end of said weight, a button vertically slidable in the top of said housing, a nest centrally fixed in said housing, said upper end of said weight being disposed in said nest and normally maintained therein in response to force of said spring, said button having a tapered lower surface surrounding said nest, said weight being movable downwardly in response to predetermined deceleration of said switch causing said upper end to move out of said nest and pivot adjacent said wiper while moving upwardly and outwardly along the bottom surface of said button, said wiper being moved from said normally closed terminal to connect said common terminal to said normally open terminal whereby conduction of current to said fuel pump is changed.

* * * * *